US010580602B2

(12) United States Patent
Morikawa et al.

(10) Patent No.: US 10,580,602 B2
(45) Date of Patent: Mar. 3, 2020

(54) HERMETIC TERMINAL FOR HIGH-CAPACITY RELAY AND CONTACT DEVICE FOR HIGH-CAPACITY RELAY INCLUDING THE HERMETIC TERMINAL

(71) Applicant: SCHOTT Japan Corporation, Koka-shi, Shiga (JP)

(72) Inventors: Tetsushi Morikawa, Koka (JP); Akira Okuno, Koka (JP); Susumu Nishiwaki, Koka (JP); Yutaka Onezawa, Koka (JP)

(73) Assignee: SCHOTT Japan Corporation, Koka-shi, Shiga (JP)

( * ) Notice: Subject to any disclaimer, the term of this patent is extended or adjusted under 35 U.S.C. 154(b) by 69 days.

(21) Appl. No.: 15/764,557

(22) PCT Filed: Sep. 29, 2016

(86) PCT No.: PCT/JP2016/078791
§ 371 (c)(1),
(2) Date: Mar. 29, 2018

(87) PCT Pub. No.: WO2017/057554
PCT Pub. Date: Apr. 6, 2017

(65) Prior Publication Data

US 2018/0286614 A1 Oct. 4, 2018

(30) Foreign Application Priority Data

Oct. 2, 2015 (JP) ..... 2015-196421

(51) Int. Cl.
*H01R 9/16* (2006.01)
*H01H 50/02* (2006.01)
(Continued)

(52) U.S. Cl.
CPC ..... *H01H 50/023* (2013.01); *H01H 50/02* (2013.01); *H01H 50/14* (2013.01);
(Continued)

(58) Field of Classification Search
CPC ..... H01H 50/023; H01H 50/02; H01H 50/14; H01H 9/16; H01H 51/065; H01H 2050/025; H01H 2223/008
See application file for complete search history.

(56) References Cited

U.S. PATENT DOCUMENTS 2,654,070 A * 9/1953 Lamb ..... G01R 1/02 324/155
3,018,418 A * 1/1962 Conrad ..... H01F 7/1833 361/210
(Continued)

FOREIGN PATENT DOCUMENTS

CN 202443919 U 9/2012
FR 2790334 A1 * 9/2000 ..... H01R 9/16
(Continued)

OTHER PUBLICATIONS

Japanese Office Action in Japanese Patent Application No. 2015-196421, dated Mar. 13, 2018, 4 pages, with English translation, 4 pages.
(Continued)

*Primary Examiner* — Mohamad A Musleh
(74) *Attorney, Agent, or Firm* — W. F. Fasse

(57) ABSTRACT

A hermetic terminal for a high-capacity relay includes: a metal container provided with a through hole; a pipe lead inserted through the through hole; an insulating glass hermetically sealing the metal container and the pipe lead; and a terminal base passing through and hermetically secured to the pipe lead and made of a low-resistance metal.

15 Claims, 5 Drawing Sheets

(51) Int. Cl.
*H01H 50/14* (2006.01)
*H01H 51/06* (2006.01)

(52) U.S. Cl.
CPC ..... *H01R 9/16* (2013.01); *H01H 51/065* (2013.01); *H01H 2050/025* (2013.01); *H01H 2223/008* (2013.01)

(56) References Cited

U.S. PATENT DOCUMENTS

| | | | | |
|---|---|---|---|---|
| 3,667,870 | A * | 6/1972 | Yoshida et al. ..... | F04D 13/0646 417/357 |
| 2009/0120686 | A1* | 5/2009 | Paterek ..... | F04C 23/008 174/650 |
| 2014/0360985 | A1 | 12/2014 | Takaya et al. | |
| 2016/0181038 | A1 | 6/2016 | Shimizu et al. | |
| 2016/0233039 | A1 | 8/2016 | Kanematsu et al. | |
| 2017/0148596 | A1* | 5/2017 | Ozaki ..... | H01H 49/00 |

FOREIGN PATENT DOCUMENTS

| | | | |
|---|---|---|---|
| JP | 50-025972 | U | 8/1975 |
| JP | 58-068642 | U | 5/1983 |
| JP | 06044880 | A * | 2/1994 |
| JP | 2013-191326 | A | 9/2013 |
| JP | 2014-164978 | A | 9/2014 |
| JP | 2015-046377 | A | 3/2015 |
| JP | 2015-049939 | A | 3/2015 |

OTHER PUBLICATIONS

Chinese Office Action and Search Report in Chinese Patent Application No. 2016-80056631.2, dated Nov. 1, 2018, 6 pages, with English translation, 8 pages.

PCT International Search Report of the International Searching Authority for International Application PCT/JP2016/078791, dated Nov. 22, 2016, 2 pages, Japanese Patent Office, Tokyo, Japan.

PCT International Preliminary Report on Patentability including English Translation of PCT Written Opinion of the International Searching Authority for International Application PCT/JP2016/078791, dated Apr. 3, 2018, 7 pages, International Bureau of WIPO, Geneva, Switzerland.

Hideki Enomoto et al., "Compact and Lightweight DC Power Relay for Electric Vehicles and Hybrid Electric Vehicles", Panasonic Electric Works technical report (vol. 58, No. 4), Dec. 2010, pp. 11 to 15, with partial English translation.

* cited by examiner

HERMETIC TERMINAL FOR HIGH-CAPACITY RELAY AND CONTACT DEVICE FOR HIGH-CAPACITY RELAY INCLUDING THE HERMETIC TERMINAL

TECHNICAL FIELD

The present invention relates to a hermetic terminal used in a high-capacity relay, and a contact device for a relay including the hermetic terminal.

BACKGROUND ART

Foreign and domestic automobile manufacturers have put hybrid vehicles (hereinafter abbreviated as HEV) to practical use as measures against environmental problems such as global warming. Currently, HEVs are also diversified into large-sized vehicles, recreational vehicles and the like. Development of electric vehicles (hereinafter abbreviated as EV) is also active. HEVs and EVs require a great motor output and a high-capacity battery is mounted thereon.

Therefore, in order to drive HEVs and EVs stably and efficiently, a high-performance high-capacity relay is essential. A vehicle-mounted high-capacity relay is attached to a limited space, and thus, a reduction in size and weight is required. In addition, in order to improve the energization performance of the relay, it is necessary to suppress an increase in temperature during continuous energization as much as possible, while using a low-resistance metal in an energized portion. Furthermore, because of a vehicle-mounted component, the high-capacity relay also requires robustness and reliability to withstand severe vibrations and temperature load (refer to NPD 1).

An example of such a high-capacity relay is an electromagnetic relay described in Japanese Patent Laying-Open No. 2015-046377 (PTD 1). This electromagnetic relay includes an electromagnet device, a contact device and a trip device.

The electromagnet device has a first exciting coil, a movable element and a first stator. The electromagnet device attracts the movable element to the first stator by a magnetic flux generated when the first exciting coil is energized, and moves the movable element from a second position to a first position.

The contact device has a fixed contact and a movable contact. The movable contact moves with the movement of the movable element, and thus, a closed state in which the movable contact is in contact with the fixed contact is formed when the movable element is located in the first position, and an open state in which the movable contact is away from the fixed contact is formed when the movable element is located in the second position and in a third position.

The trip device has a second exciting coil connected in series to the contact device. The trip device moves the movable element to the third position by a magnetic flux generated by the second exciting coil when an abnormal current of not less than a prescribed value flows through the contact device in a state in which the movable element is located in the first position.

The contact device, the electromagnet device and the trip device are aligned in one direction. The trip device is disposed on the side opposite to the contact device with respect to the electromagnet device.

As such a contact device forming a vehicle-mounted high-capacity relay, a contact device in which a space having a fixed contact and a movable contact arranged therein is a hermetic space and the space is filled with an arc-extinguishing gas (insulating gas) has been conventionally used in order to quickly extinguish an arc generated when the contacts are opened.

For example, in a contact device described in Japanese Patent Laying-Open No. 2015-049939 (PTD 2), a housing, a coupling body, a plate, and a plunger cap are hermetically joined to form a hermetic space that houses a fixed contact and a movable contact. In the contact device, a space surrounded by the housing, the coupling body, the plate, and the plunger cap is the hermetic space and an arc-extinguishing gas mainly composed of hydrogen is injected into this hermetic space.

CITATION LIST

Non Patent Document

NPD 1: "Compact and Lightweight DC Power Relay for Electric Vehicles and Hybrid Electric Vehicles", Panasonic Electric Works technical report (Vol. 58, No. 4), December, 2010, p. 11 to p. 15

Patent Document

PTD 1: Japanese Patent Laying-Open No. 2015-046377
PTD 2: Japanese Patent Laying-Open No. 2015-049939

SUMMARY OF INVENTION

Technical Problem

A conventional contact device used in a high-capacity relay includes a hermetic housing formed by airtightly sealing a ceramic housing with a metal lid by metallization, a pair of terminal bases passing through and secured to the ceramic housing, a pair of fixed contacts supported by the terminal bases, a movable contactor supported by a shaft passing through the lid, and a pair of movable contacts provided in the movable contactor.

In such a conventional contact device, the housing is made of a ceramic material. The ceramic housing is likely to be subjected to leakage of hydrogen of an arc-extinguishing gas from a housing wall due to a porous structure specific to a sintered material, and the ceramic housing is also mechanically brittle. Therefore, a thickness of the housing wall cannot be reduced too much, and thus, a reduction in size and weight is limited. Since a hermetic ceramic housing is manufactured by firing a special ceramic material for vacuum at high temperature, the hermetic ceramic housing is not an inexpensive member and is not necessarily economically efficient.

The present invention has been proposed to solve the above-described problem, and an object of the present invention is to achieve higher hermeticity in a contact device used in a high-capacity relay (high-capacity electromagnetic relay).

Solution to Problem

A hermetic terminal for a high-capacity relay according to the present invention includes: a metal container provided with a through hole; a pipe lead inserted through the through hole; an insulating glass hermetically sealing the pipe lead and the metal container; and a terminal base passing through and hermetically secured to the pipe lead and made of a low-resistance metal.

In an embodiment of the hermetic terminal for the high-capacity relay, the metal container has a flat plate provided with the through hole, and a peripheral wall provided around the flat plate. A plate thickness of the flat plate provided with the through hole is greater than a plate thickness of the peripheral wall.

In an embodiment of the hermetic terminal for the high-capacity relay, a plate thickness of a concentric portion around the through hole is greater than a plate thickness of a portion other than the concentric portion.

In an embodiment of the hermetic terminal for the high-capacity relay, the metal container has a heat-resistant insulating material on an inner wall surface thereof.

A contact device for a high-capacity relay according to the present invention includes the hermetic terminal for the high-capacity relay as described above, and is opened and closed by an electromagnet device. The contact device for the high-capacity relay further includes: a fixed contact supported by the terminal base; a lid covering and airtightly sealing an opening provided in the metal container; a shaft passing through the lid; a movable contactor supported by the shaft; and a movable contact provided in the movable contactor.

In an embodiment of the contact device for the high-capacity relay, the lid has a heat-resistant insulating material on an inner wall surface thereof.

Advantageous Effects of Invention

According to the hermetic terminal for the high-capacity relay and the contact device for the high-capacity relay in the present invention, a contact device having high hermeticity can be achieved.

DESCRIPTION OF EMBODIMENTS

A hermetic terminal for a high-capacity relay according to the present invention and a contact device for a high-capacity relay including the hermetic terminal will be described hereinafter with reference to the drawings.

Figure 1A:
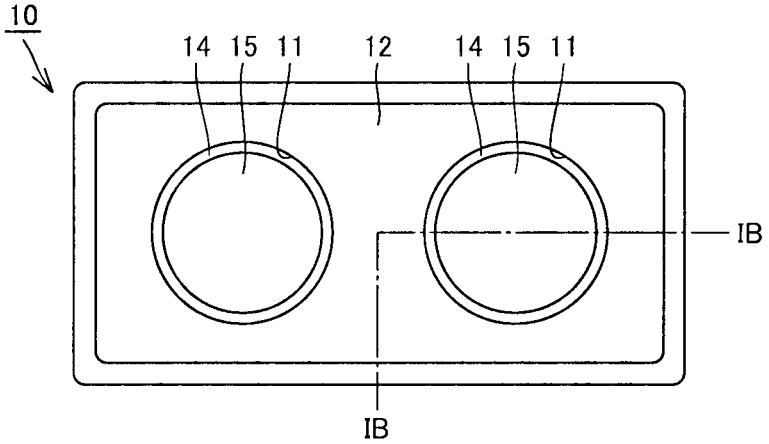
FIG. 1A is a plan view showing a hermetic terminal for a high-capacity relay in a first embodiment.
Figure 1B:
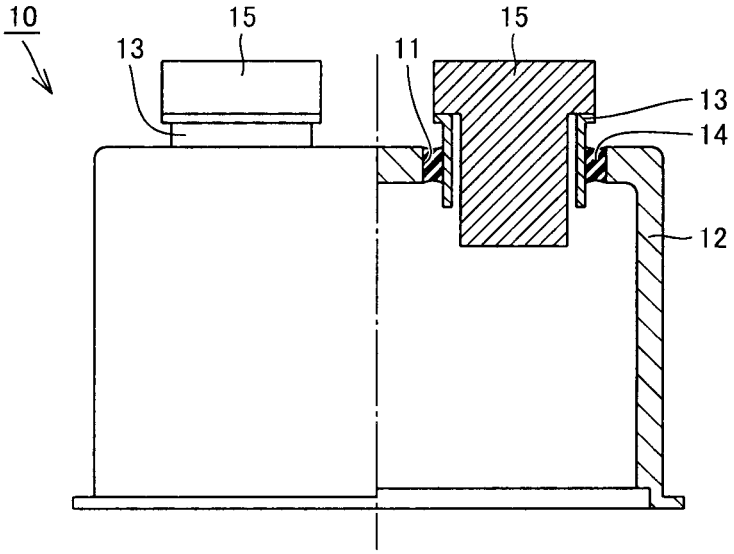
FIG. 1B is a cross-sectional view of a front portion of the hermetic terminal for the high-capacity relay in the first embodiment partially cut along line IB-IB in FIG. 1A.
Figure 1C:
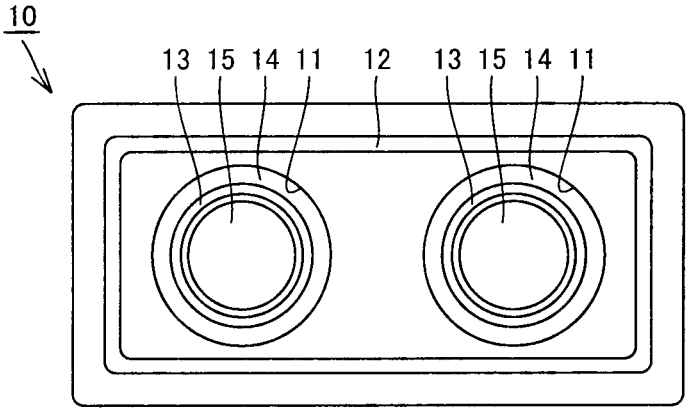
FIG. 1C is a bottom view showing the hermetic terminal for the high-capacity relay in the first embodiment.

As shown in FIGS. 1A to 1C, a hermetic terminal 10 for a high-capacity relay according to a first embodiment includes a metal container 12 provided with a through hole 11, a pipe lead 13 inserted through through hole 11, an insulating glass 14 hermetically sealing pipe lead 13 and metal container 12, and a terminal base 15 passing through and hermetically secured to pipe lead 13 and made of a low-resistance metal.

Metal container 12 is made of a metal such as iron or an iron alloy. Pipe lead 13 is made of a metal such as iron or an iron alloy. Insulating glass 14 is made of borosilicate glass, soda barium glass or the like. Terminal base 15 is made of a low-resistance metal such as copper or a copper alloy.

In the embodiment shown in FIGS. 1A to 1C, metal container 12 is formed in the shape of substantially a box having an opening in a lower surface. The plates forming the respective surfaces of metal container 12 have a substantially uniform thickness. In metal container 12, a plate thickness enough for hermetic sealing between pipe lead 13 and metal container 12 by glass sealing may only be ensured at least around through hole 11. In metal container 12 according to the present embodiment, the plate thickness of the portion of metal container 12 around through hole 11 may be thick, and a plate thickness of the other portion may be smaller than the plate thickness of the portion of metal container 12 around through hole 11.

The above-described glass sealing may be either matching sealing or compression sealing. When the thickness of metal container 12 is thick only around through hole 11 as described above, a large internal volume of a relay contact device can be achieved. As a result, the relay contact device can be reduced in size.

Terminal base 15 has a large-diameter disc portion, and a columnar portion having a diameter smaller than that of the disc portion and connected to a center of a lower surface of the disc portion. Pipe lead 13 has a hollow cylindrical portion, and a flange portion provided at an upper end of the hollow cylindrical portion and extending to the outside. The columnar portion of terminal base 15 passes through the cylindrical portion of pipe lead 13. A gap (space) is provided between an inner circumferential surface of the cylindrical portion of pipe lead 13 and an outer circumferential surface of the columnar portion of terminal base 15. An outer circumferential surface of pipe lead 13 and an inner circumferential surface of through hole 11 are hermetically sealed by insulating glass 14. A gap is provided between an inner circumferential surface of a portion of pipe lead 13 in contact with insulating glass 14 and an outer circumferential surface of a corresponding portion of terminal base 15. An upper surface of the flange portion of pipe lead 13 and an outer circumferential portion of the lower surface of the disc portion of terminal base 15 are joined by welding, brazing or the like, with the hermeticity being maintained.

If a terminal base made of a low-resistance metal such as copper that is low in energization loss is passed through a through hole of a metal container made of steel or the like, and the metal container and the terminal base are directly sealed by an insulating glass, the glass sealing portion is broken due to great thermal expansion of the terminal base made of copper or the like, and thus, the hermeticity of the metal container is not maintained. Therefore, a hermetic terminal has not been used in a conventional high-capacity relay.

According to hermetic terminal 10 for the high-capacity relay in the present embodiment, pipe lead 13 is attached to the outer circumference of terminal base 15 with the space being interposed, and pipe lead 13 and metal container 12 are sealed by insulating glass 14. The space provided between pipe lead 13 and terminal base 15 makes it possible to buffer thermal expansion of terminal base 15 well and prevent breaking of insulating glass 14. Even when the metal container is used as a container, breaking of insulating glass 14 can be prevented and the high hermeticity can be maintained.

According to hermetic terminal 10 for the high-capacity relay in the present embodiment, the conventionally-used container having a ceramic metallized structure is replaced with the metal container, and thus, an inexpensive structure excellent in hermeticity can be achieved.

Figure 2A:
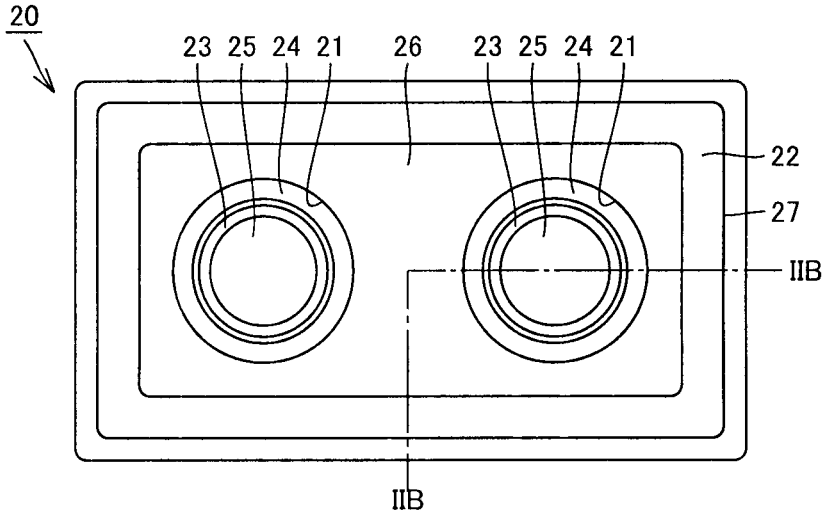
FIG. 2A is a plan view showing a hermetic terminal for a high-capacity relay in a second embodiment.
Figure 2B:
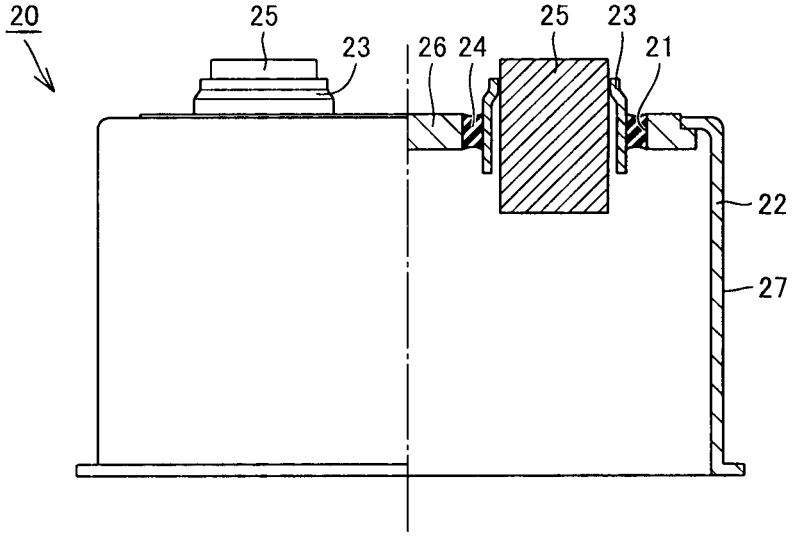
FIG. 2B is a cross-sectional view of a front portion of the hermetic terminal for the high-capacity relay in the second embodiment partially cut along line IIB-IIB in FIG. 2A.
Figure 2C:
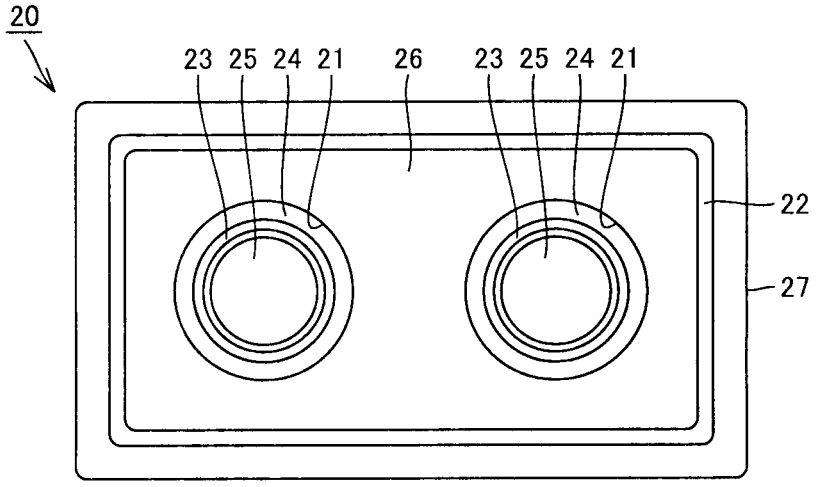
FIG. 2C is a bottom view showing the hermetic terminal for the high-capacity relay in the second embodiment.

A hermetic terminal 20 for a high-capacity relay in a second embodiment shown in FIGS. 2A to 2C is a modified version of hermetic terminal 10 for the high-capacity relay in the first embodiment.

Hermetic terminal 20 for the high-capacity relay in the second embodiment includes a metal container 22 provided with a through hole 21, a pipe lead 23 inserted through through hole 21, an insulating glass 24 hermetically sealing pipe lead 23 and metal container 22, and a terminal base 25 passing through and hermetically secured to pipe lead 23 and made of a low-resistance metal.

Metal container 22 is made of a metal such as iron or an iron alloy. Pipe lead 23 is made of a metal such as iron or an iron alloy. Insulating glass 24 is made of borosilicate glass, soda barium glass or the like. Terminal base 25 is made of a low-resistance metal such as copper or a copper alloy.

In metal container 22 in the second embodiment, a plate thickness of a flat plate 26 provided with through hole 21 is thick, and a plate thickness of a peripheral wall 27 not provided with through hole 21 is smaller than the plate thickness of flat plate 26. In the present embodiment, flat plate 26 provided with through hole 21 and peripheral wall 27 are formed from separate members. The thickness of the plate member forming flat plate 26 is greater than the thickness of the plate member forming peripheral wall 27. Substantially rectangular flat plate 26 is inserted into a substantially rectangular opening provided in a top surface of peripheral wall 27 and an outer peripheral portion of flat plate 26 is joined to the opening of peripheral wall 27. Flat plate 26 and peripheral wall 27 do not necessarily need to be formed from separate members. For example, metal container 22 may be integrally formed by casting, cutting or the like, and at this time, flat plate 26 and peripheral wall 27 may be formed to have different thicknesses.

In the present embodiment, terminal base 25 has a columnar shape. An upper end of pipe lead 23 has a diameter smaller than that of a main body portion of pipe lead 23. Although terminal base 25 passes through pipe lead 23, a gap is provided between terminal base 25 and the main body portion of pipe lead 23. The small-diameter portion at the upper end of pipe lead 23 is hermetically joined to an outer circumferential upper portion of terminal base 25. A space is provided between an inner circumferential surface of a portion of pipe lead 23 in contact with insulating glass 24 and an outer circumferential surface of a corresponding portion of terminal base 25.

The space provided between pipe lead 23 and terminal base 25 makes it possible to buffer thermal expansion of terminal base 25 well and prevent breaking of insulating glass 24. Even when the metal container is used as a container, breaking of insulating glass 24 can be prevented and the high hermeticity can be maintained.

Figure 3A:
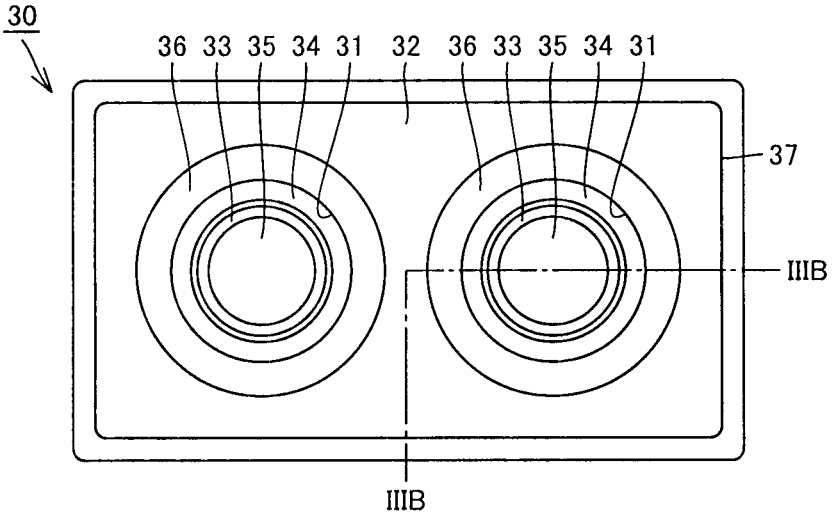
FIG. 3A is a plan view showing a hermetic terminal for a high-capacity relay in a third embodiment.
Figure 3B:
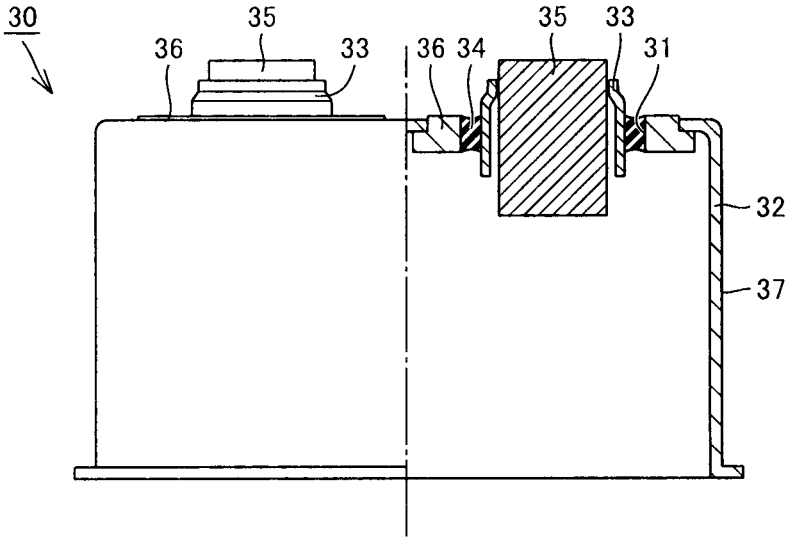
FIG. 3B is a cross-sectional view of a front portion of the hermetic terminal for the high-capacity relay in the third embodiment partially cut along line IIIB-IIIB in FIG. 3A.
Figure 3C:
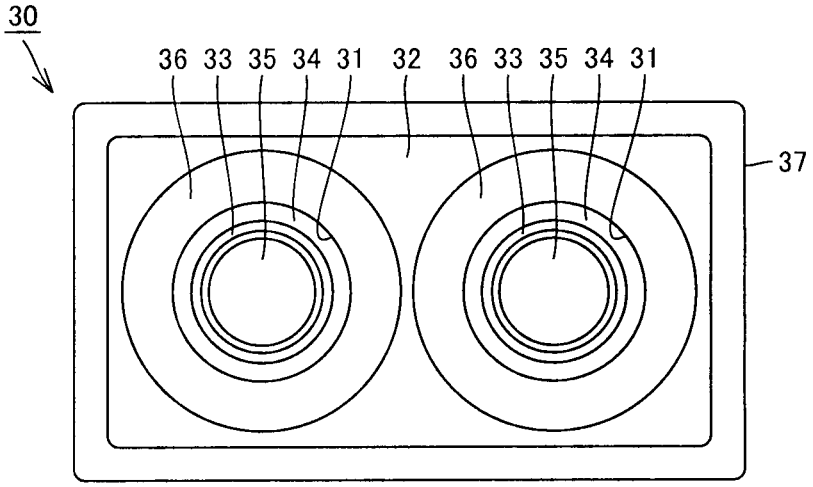
FIG. 3C is a bottom view showing the hermetic terminal for the high-capacity relay in the third embodiment.

A hermetic terminal 30 for a high-capacity relay in a third embodiment shown in FIGS. 3A to 3C is a modified version of hermetic terminal 10 for the high-capacity relay and hermetic terminal 20 for the high-capacity relay in the first and second embodiments.

Hermetic terminal 30 for the high-capacity relay in the third embodiment includes a metal container 32 provided with a through hole 31, a pipe lead 33 inserted through through hole 31, an insulating glass 34 hermetically sealing pipe lead 33 and metal container 32, and a terminal base 35 passing through and hermetically secured to pipe lead 33 and made of a low-resistance metal.

Metal container 32 is made of a metal such as iron or an iron alloy. Pipe lead 33 is made of a metal such as iron or an iron alloy. Insulating glass 34 is made of borosilicate glass, soda barium glass or the like. Terminal base 35 is made of a low-resistance metal such as copper or a copper alloy.

In metal container 32 in the third embodiment, a plate thickness of a concentric portion 36 around through hole 31 is thick, and a plate thickness of a metal container main body 37 which is the other portion is smaller than the plate thickness of concentric portion 36.

In the present embodiment, concentric portion 36 provided with through hole 31 and metal container main body 37 are formed from separate members. The thickness of the plate member forming concentric portion 36 is greater than the thickness of the plate member forming metal container main body 37. Circular concentric portion 36 is inserted into a circular opening provided in a top surface of metal container main body 37, and an outer circumferential portion of concentric portion 36 is joined to the opening of metal container main body 37. Concentric portion 36 and metal container main body 37 do not necessarily need to be formed from separate members. For example, metal container 32 may be integrally formed by casting, cutting or the like, and at this time, concentric portion 36 and metal container main body 37 may be formed to have different thicknesses.

In the present embodiment, terminal base 35 has a columnar shape. An upper end of pipe lead 33 has a diameter smaller than that of a main body portion of pipe lead 33. Although terminal base 35 passes through pipe lead 33, a gap is provided between terminal base 35 and the main body portion of pipe lead 33. The small-diameter portion at the upper end of pipe lead 33 is hermetically joined to an outer circumferential upper portion of terminal base 35. A space is provided between an inner circumferential surface of a portion of pipe lead 33 in contact with insulating glass 34 and an outer circumferential surface of a corresponding portion of terminal base 35.

The space provided between pipe lead 33 and terminal base 35 makes it possible to buffer thermal expansion of terminal base 35 well and prevent breaking of insulating glass 34. Even when the metal container is used as a container, breaking of insulating glass 34 can be prevented and the high hermeticity can be maintained.

In the second and third embodiments, the metal container is configured such that the thickness of the portion around the through hole is different from the thickness of the other portion. In this case, as the metal container, an integrated container that differs in thickness from portion to portion may be selected, or a container formed by hermetically securing a plurality of metal members having different thicknesses to each other by welding, brazing or the like may be selected.

A contact device for a high-capacity relay according to the present invention is a contact device for a relay in which hermetic terminals 10, 20 and 30 for the high-capacity relays described in the first to third embodiments as one example are used in the metal container.

Figure 4A:
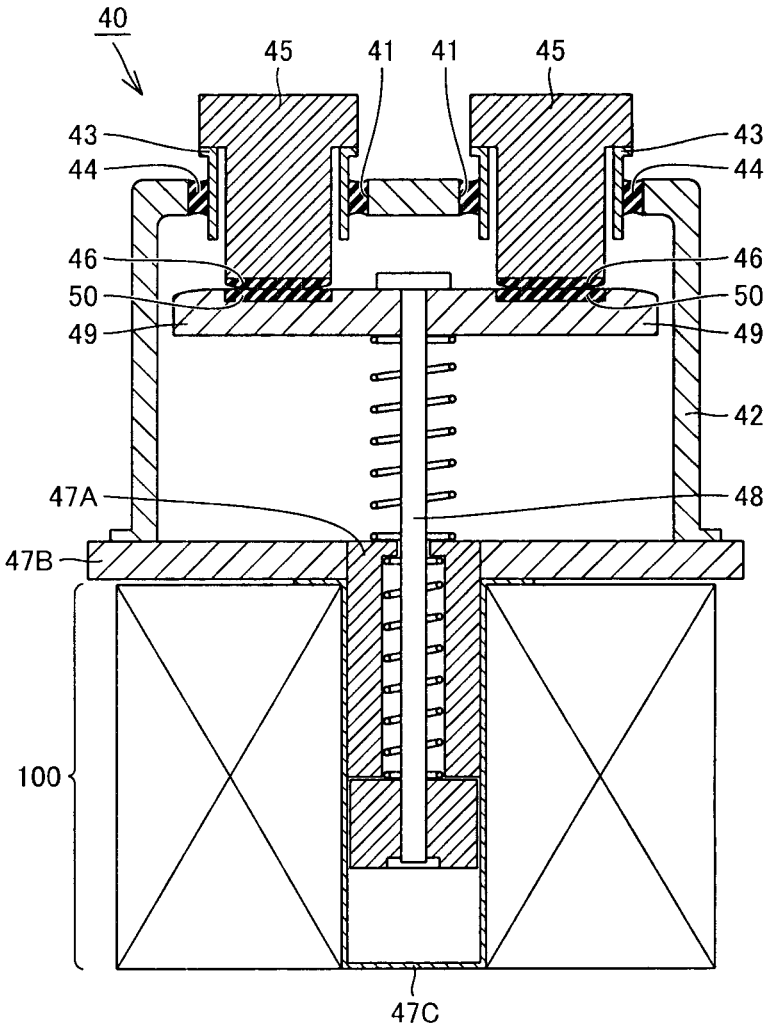
FIG. 4A is a front cross-sectional view showing a closed state of a contact device for a high-capacity relay in one embodiment.
Figure 4B:
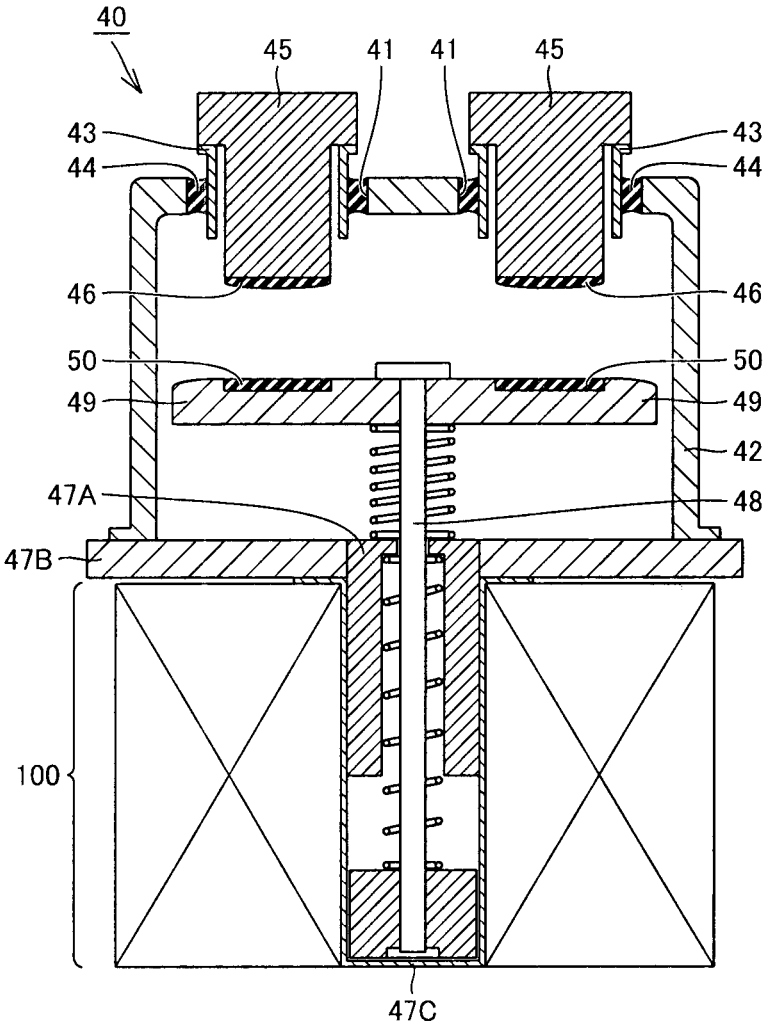
FIG. 4B is a front cross-sectional view showing an open state of the contact device for the high-capacity relay in one embodiment.

A contact device 40 for a high-capacity relay in the present embodiment shown in FIGS. 4A and 4B is an electromagnetic relay configured to open and close the contact device by an electromagnet device 100. Contact device 40 for the high-capacity relay includes a metal container 42 provided with a through hole 41, a pipe lead 43 inserted through through hole 41, an insulating glass 44 hermetically sealing pipe lead 43 and metal container 42, a terminal base 45 passing through and hermetically secured to pipe lead 43 and made of a low-resistance metal, a fixed contact 46 supported by terminal base 45, a lid covering and airtightly sealing an opening provided in the metal container, a movable contactor 49 supported by a shaft 48 passing through the lid, and a movable contact 50 provided in movable contactor 49.

Metal container 42 is made of a metal such as iron or an iron alloy. Pipe lead 43 is made of a metal such as iron or an iron alloy. Insulating glass 44 is made of borosilicate glass, soda barium glass or the like. Terminal base 45 is made of a low-resistance metal such as copper or a copper alloy. The lid is made of iron or an iron alloy.

Fixed contact 46 is provided in a lower surface of terminal base 45. Movable contact 50 is provided in an upper surface of movable contactor 49. Fixed contact 46 and movable contact 50 face each other. Movable contactor 49 moves upward and downward, and switching is thereby done between a closed state and an open state of fixed contact 46 and movable contact 50.

The lid includes a lid main body 47B joined to a lower end of metal container 42 and having an opening in the center, a cylindrical portion 47A having an upper end inserted into the opening in the center of lid main body 47B, and a cover portion 47C having an upper end connected to a central portion of a lower surface of lid main body 47B and surrounding an outer circumferential portion of cylindrical portion 47A.

The lid is joined to the lower end of metal container 42 by welding, brazing or the like to ensure the hermeticity of the metal container. Cover portion 47C is formed in the shape of a hat and covers a joint between lid main body 47B and cylindrical portion 47A to improve the hermeticity of the lid.

Shaft 48 passes through a central portion of the cylindrical portion. A magnet is provided at a lower end of shaft 48, and shaft 48 can be lifted and lowered by the magnetic force from electromagnet device 100 and the action of a spring provided on shaft 48.

In contact device 40 for the high-capacity relay, a heat-resistant insulating material may be attached to or a lining of a heat-resistant insulating material may be provided on an inner wall surface of metal container 42 and lid 47 as necessary in order to enhance the heat resistance and the insulation property.

In contact device 40 for the high-capacity relay in the present embodiment, the hermetic terminal for the high-capacity relay described in each of the first to third embodiments is used, and thus, there can be provided an all-metal housing excellent in hermeticity formed by compression sealing, while forming a terminal base from a low-resistance metal material having a high thermal expansion coefficient.

Thus, according to contact device 40 for the high-capacity relay in the present embodiment, the all-metal housing excellent in hermeticity that does not cause leakage of an arc-extinguishing gas such as hydrogen can be achieved, as compared with a conventional contact device including a ceramic container. In addition, the container made of a metal is excellent in processability, robustness and reliability and a thickness of the container can be reduced without decreasing the strength, and thus, the device can be reduced in size and weight. Furthermore, the metal container is excellent in thermal conductivity, and thus, the heat dissipation property of the device can be improved.

As one example, hermetic terminal 10 for the high-capacity relay in the first embodiment described above can be made of the following materials. Metal container 12 provided with through hole 11 is made of iron, pipe lead 13 inserted through through hole 11 is made of an Fe—Ni alloy, insulating glass 14 hermetically sealing pipe lead 13 and metal container 12 is made of soda barium glass, and terminal base 15 passing through pipe lead 13 is made of a copper alloy. Terminal base 15 is hermetically brazed to pipe lead 13 using a brazing material of an Ag—Cu alloy.

As one example, contact device 40 for the high-capacity relay in one embodiment can be made of the following materials. Metal container 42 provided with through hole 41 is made of iron, pipe lead 43 inserted through through hole 41 is made of an Fe—Ni alloy, insulating glass 44 hermetically sealing pipe lead 43 and metal container 42 is made of soda barium glass, the terminal base passing through pipe lead 43 is made of a copper alloy, the fixed contact supported by terminal base 45 is made of a silver alloy, lid 47 covering and airtightly sealing the opening of metal container 42 is made of an iron alloy, movable contactor 49 supported by shaft 48 passing through lid 47 is made of a copper alloy, and movable contact 50 provided in movable contactor 49 is made of a silver alloy. Terminal base 45 is hermetically brazed to pipe lead 43 using a brazing material of an Ag—Cu alloy.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The present invention is applicable to a power relay such as a system main relay mounted on HEV, EV and the like.

REFERENCE SIGNS LIST

10, 20, 30 hermetic terminal for high-capacity relay; 11, 21, 31, 41 through hole; 12, 22, 32, 42 metal container; 13, 23, 33, 43 pipe lead; 14, 24, 34, 44 insulating glass; 15, 25, 35, 45 terminal base; 26 flat portion; 27 peripheral wall; 36 concentric portion; 37 metal container main body; 40 contact device for high-capacity relay; 46 fixed contact; 47A cylindrical portion; 47B lid main body; 47C cover portion; 48 shaft; 49 movable contactor; 50 movable contact; 100 electromagnet device.

The invention claimed is:

1. A hermetic terminal for a high-capacity relay, comprising:

a metal container that has a through hole;

a pipe lead that includes a cylindrical tubular portion inserted through the through hole and a different-diameter end portion having a different diameter than the cylindrical tubular portion;

an insulating glass that hermetically seals between the cylindrical tubular portion of the pipe lead and the metal container; and a terminal base that extends through the pipe lead and is made of a low-resistance metal, wherein the different-diameter end portion of the pipe lead is hermetically joined to the terminal base, and an open spacing gap is formed and maintained between the terminal base and the cylindrical tubular portion of the pipe lead.

2. The hermetic terminal for the high-capacity relay according to claim 1, wherein:

the metal container includes a flat plate that has the through hole therein, and a peripheral wall disposed around the flat plate, and a plate thickness of the flat plate is greater than a plate thickness of the peripheral wall.

3. The hermetic terminal for the high-capacity relay according to claim 1, wherein in the metal container, a plate thickness of a concentric portion around the through hole is greater than a plate thickness of a portion other than the concentric portion.

4. The hermetic terminal for the high-capacity relay according to claim 1, further comprising a heat-resistant insulating material on an inner wall surface of the metal container.

5. A contact device for a high-capacity relay including the hermetic terminal as recited in claim 1, wherein the contact device is configured to be opened and closed by an electromagnet device, and the contact device further comprises:

a fixed contact supported by the terminal base;

a lid covering and airtightly sealing an opening in the metal container;

a shaft passing through the lid;

a movable contactor supported by the shaft; and a movable contact in the movable contactor.

6. The contact device for the high-capacity relay according to claim 5, further comprising a heat-resistant insulating material on an inner wall surface of the lid.

7. The hermetic terminal for the high-capacity relay according to claim 1, wherein the different-diameter end portion of the pipe lead comprises an end flange extending radially outwardly from an end of, and having a larger outer diameter than, the cylindrical tubular portion of the pipe lead.

8. The hermetic terminal for the high-capacity relay according to claim 1, wherein the different-diameter end portion of the pipe lead comprises a tapered portion extending tapered radially inwardly from an end of, and tapering to a smaller inner diameter and a smaller outer diameter than, the cylindrical tubular portion of the pipe lead.

9. The hermetic terminal for the high-capacity relay according to claim 1, wherein the different-diameter end portion of the pipe lead is an outer end portion of the pipe lead protruding outwardly away from the metal container.

10. The hermetic terminal for the high-capacity relay according to claim 1, wherein the pipe lead is joined to the terminal base only at the different-diameter end portion.

11. The hermetic terminal for the high-capacity relay according to claim 1, wherein the different-diameter end portion is located at a first end of the cylindrical tubular portion, and a second end of the cylindrical tubular portion of the pipe lead opposite the first end is not joined to the terminal base and maintains the open spacing gap between the terminal base and the second end of the cylindrical tubular portion.

12. The hermetic terminal for the high-capacity relay according to claim 1, wherein the open spacing gap between the terminal base and the cylindrical tubular portion of the pipe lead is maintained in open communication with a hermetically sealed interior space formed inside the metal container.

13. The hermetic terminal for the high-capacity relay according to claim 1, wherein the metal container is made of a first metal, and the low-resistance metal of the terminal base has a higher coefficient of thermal expansion than the first metal of the metal container.

14. The hermetic terminal for the high-capacity relay according to claim 13, wherein the first metal is iron or an iron alloy, and the low-resistance metal is copper or a copper alloy.

15. The hermetic terminal for the high-capacity relay according to claim 1, wherein an inner cylindrical surface of the different-diameter end portion of the pipe lead is hermetically joined to an outer cylindrical surface of a first portion of the terminal base, while forming and maintaining the open spacing gap between an outer cylindrical surface of a second portion of the terminal base and an inner cylindrical surface of the cylindrical tubular portion of the pipe lead.

* * * * *